US010716172B2

(12) United States Patent
Weissenberger et al.

(10) Patent No.: US 10,716,172 B2
(45) Date of Patent: Jul. 14, 2020

(54) METHOD FOR DEPOSITING A BUSBAR ON VEHICLE PLASTIC PANES WITH A HEATING FUNCTION

(71) Applicant: SAINT-GOBAIN GLASS FRANCE, Courbevoie (FR)

(72) Inventors: Uwe Weissenberger, Wuerzburg (DE); Marcus Guldan, Uhingen (DE); Sebastian Schmidt, Stuttgart (DE)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 348 days.

(21) Appl. No.: 15/554,701

(22) PCT Filed: Mar. 21, 2016

(86) PCT No.: PCT/EP2016/056182

§ 371 (c)(1),
(2) Date: Aug. 30, 2017

(87) PCT Pub. No.: WO2016/146856

PCT Pub. Date: Sep. 22, 2016

(65) Prior Publication Data

US 2018/0242403 A1 Aug. 23, 2018

(30) Foreign Application Priority Data

Mar. 19, 2015 (EP) ..... 15159882

(51) Int. Cl.
*H05B 3/84* (2006.01)
*B22F 1/02* (2006.01)

(52) U.S. Cl.
CPC ..... *H05B 3/84* (2013.01); *B22F 1/02* (2013.01); *H05B 2203/011* (2013.01);
(Continued)

(58) Field of Classification Search
CPC ... H05B 3/06; H05B 3/84; H05B 3/86; H05B 2203/014; H05B 2203/016; H05B 2203/017; H05B 2203/031
See application file for complete search history.

(56) References Cited

U.S. PATENT DOCUMENTS 5,766,739 A * 6/1998 Funaki ..... H05B 3/84 219/203
6,023,837 A 2/2000 Finn
(Continued)

FOREIGN PATENT DOCUMENTS

CN 101375637 A 2/2009
CN 101962270 A 2/2011
(Continued)

OTHER PUBLICATIONS

International Search Report for PCT/EP2016/056182 filed Mar. 21, 2016 on behalf of Saint-Gobain Glass France. dated May 18, 2016. 7 ppages. (German +English).

*Primary Examiner* — Brian W Jennison
(74) *Attorney, Agent, or Firm* — Pillsbury Winthrop Shaw Pittman LLP

(57) ABSTRACT

A method for producing a vehicle plastic pane having a heating function is presented. The method includes: the provisioning of a one- or two-component, semi-transparent, polymeric pane base body; the coating of the pane base body with a protective coating; the embedding of heating wires for direct electrical contact with busbars that are deposited; the usage of a fine powder coating (FPC) plasma process at atmospheric pressure to deposit the busbars; and the mounting a connection element on and/or in each of the busbars.

17 Claims, 8 Drawing Sheets

Figure 1:
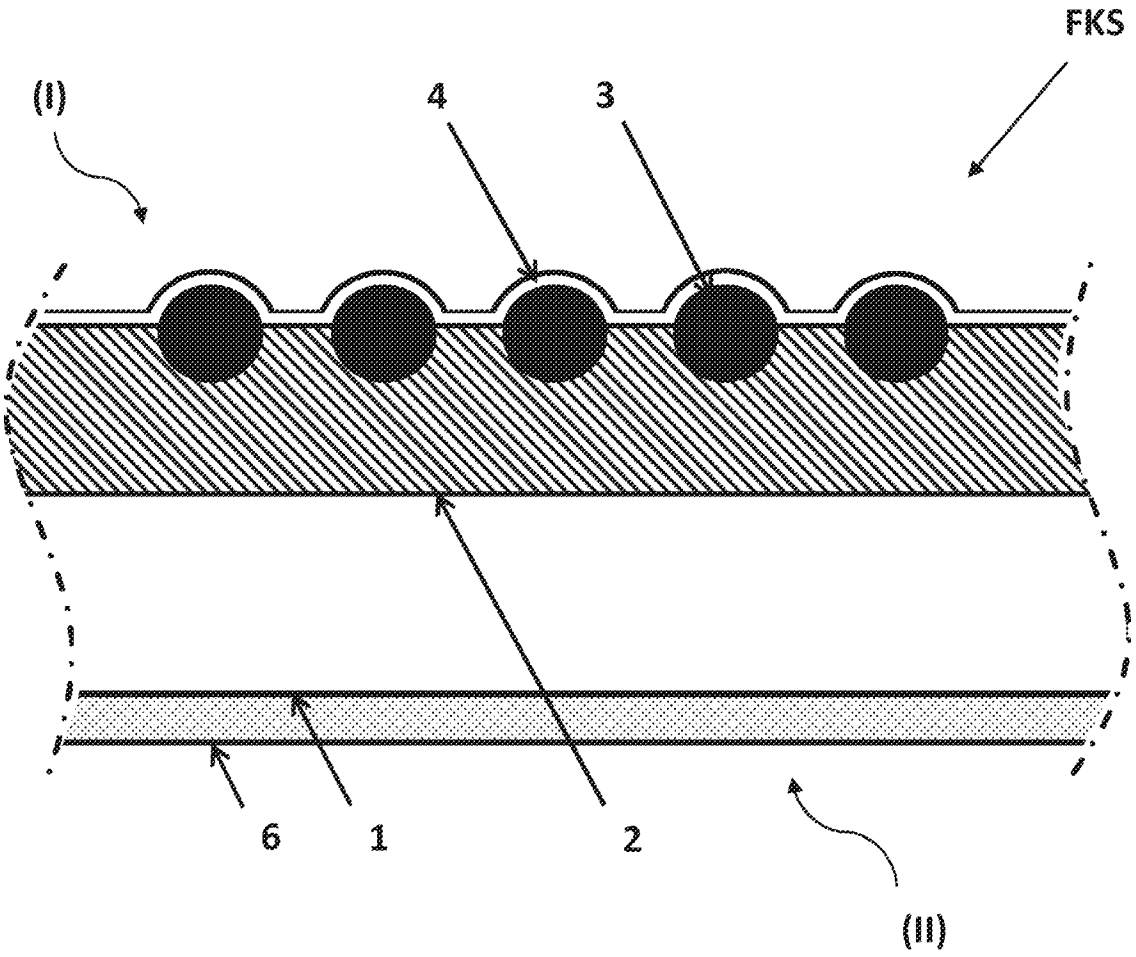

(52) U.S. Cl.
CPC .. *H05B 2203/014* (2013.01); *H05B 2203/016* (2013.01); *H05B 2203/017* (2013.01)

(56) References Cited

U.S. PATENT DOCUMENTS

| | | | | |
|---|---|---|---|---|
| 7,265,322 | B2 | 9/2007 | Aengenheyster et al. | |
| 2006/0096967 | A1* | 5/2006 | Weiss | H05B 3/84 219/203 |
| 2012/0080421 | A1* | 4/2012 | Macher | H05B 3/84 219/522 |
| 2012/0261391 | A1 | 10/2012 | Ihde et al. | |
| 2014/0170410 | A1 | 6/2014 | Rupprecht et al. | |
| 2014/0302235 | A1 | 10/2014 | Fleischmann et al. | |
| 2014/0332518 | A1 | 11/2014 | Lesmeister et al. | |
| 2015/0181653 | A1* | 6/2015 | Lesmeister | H05B 3/06 219/203 |
| 2015/0273986 | A1 | 10/2015 | Benyahia et al. | |

FOREIGN PATENT DOCUMENTS

| | | | |
|---|---|---|---|
| CN | 104039609 | A | 9/2014 |
| DE | 10147537 | A1 | 4/2003 |
| DE | 102008029681 | A1 | 12/2009 |
| DE | 102008058783 | A1 | 5/2010 |
| DE | 102009048297 | A1 | 4/2011 |
| DE | 102009048397 | A1 | 4/2011 |
| EP | 0252489 | A2 | 1/1988 |
| EP | 0435144 | A1 | 7/1991 |
| EP | 2278851 | A1 | 1/2011 |
| EP | 2794366 | A1 | 10/2014 |
| JP | H05-144552 | A | 6/1993 |
| JP | H06-089775 | A | 3/1994 |
| JP | 2010-103041 | A | 5/2010 |
| JP | 2014-521835 | A | 8/2014 |
| KR | 10-2007-0084577 | A | 8/2007 |
| KR | 10-2007-0096407 | A | 10/2007 |
| KR | 10-2010-0103371 | A | 9/2010 |
| KR | 10-2011-0060946 | A | 6/2011 |
| KR | 10-2014-0098162 | A | 8/2014 |
| WO | 2006/063064 | A1 | 6/2006 |
| WO | 2006/091955 | A1 | 8/2006 |
| WO | 2007/076502 | A1 | 7/2007 |
| WO | 2008/137946 | A1 | 11/2008 |
| WO | 2013/087290 | A1 | 6/2013 |
| WO | 2013/091964 | A1 | 6/2013 |
| WO | 2013/092253 | A1 | 6/2013 |
| WO | 2014/060338 | A1 | 4/2014 |
| WO | 2014/067745 | A1 | 5/2014 |

* cited by examiner

METHOD FOR DEPOSITING A BUSBAR ON VEHICLE PLASTIC PANES WITH A HEATING FUNCTION

CROSS-REFERENCE TO RELATED APPLICATIONS

The present application is the U.S. National Stage of International Patent Application No. PCT/EP2016/056182 filed on Mar. 21, 2016 which, in turn, claims priority to European Patent Application No. 15159882.8 filed on Mar. 19, 2015.

The present invention relates to a method for depositing an electrical busbar on vehicle plastic panes with a heating function by means of the fine powder coating (FPC) plasma process. Moreover, the present invention relates to vehicle plastic panes with a heating function that were produced using this method. And, last but not least, the present invention relates to the use of the vehicle plastic panes according to the invention.

In the wake of increasingly stringent requirements regarding carbon dioxide emissions of vehicles, there are strong efforts to reduce the weight of a vehicle and, hence, its fuel consumption. Constant innovations in the plastics sector enable the replacement of large parts of the metal car body with correspondingly lighter elements made of polymeric materials. In particular, parts or even the entire window region can be replaced by elements made of polymeric materials. In many cases, along with a significantly lower weight, these present hardness, stability, and toughness comparable to that with a car body window made of glass. Additionally, due to the weight reduction, the center of gravity of the vehicle is moved lower, which has a positive effect on handling. Also, compared to glass, polymeric materials can be produced, processed, and shaped at significantly lower temperatures. This reduces energy consumption and costs in the production of the materials. Molded parts made of polymeric materials can be produced in virtually any desired shape and geometry. Special high-performance plastics such as aramids, for example, Kevlar, have very high strength and stability.

The effectiveness of motor vehicle lighting can be impaired at low ambient temperatures, in particular in the winter. Snow, ice, or condensed atmospheric moisture can accumulate on the outer side of the cover of the motor vehicle luminaire. Atmospheric moisture can also condense and freeze on the inner side of the luminaire cover. This lessens the transparency of the luminaire cover and reduces the functionality of the lighting. Road safety is disadvantageously affected. Motor vehicle headlights were formerly equipped primarily with halogen lamps or xenon lamps. These lamps develop significant heat during operation. The heat is transferred to the luminaire cover and results in defrosting and/or drying of the luminaire cover. Nowadays, motor vehicle headlights are increasingly equipped with light emitting diodes (LED), which generate significantly less heat during operation. Consequently, active heating of the luminaire cover is necessary for the removal of moisture and ice.

Many material parts made of plastic must comply with various requirements and functions. In this regard, important parameters are stability, fracture behavior, scratch resistance, impact strength, or notched impact strength. In addition to technical considerations such as weight and strength of the individual material phases, shape, geometry, and appearance play an increasingly important role. Especially in the automobile industry, in addition to mechanical properties, characteristics in the area of design and aesthetics are also of major significance. In order to combine various characteristics in polymeric materials, they are composed of basic materials of different shapes and different natures. Established methods for producing these materials include two- or multi-component injection molding processes. In this manner, it is possible to combine characteristics such as weather resistance, surface gloss, and fracture resistance or torsional stability with one another. In addition, the proportions of very expensive materials can be reduced.

Vehicle panes, including luminaire covers, that have an active heating function and that are substantially made of plastic are known.

Thus, from the international patent application WO 2014/067745 A1, a polymeric vehicle glazing made of plastic that has an outer surface, i.e., a side facing the environment, and an inner surface, i.e., a side facing the vehicle interior, is known. On the outer surface, the vehicle glazing has a semi-transparent polymeric material phase; and on its inner surface, an opaque polymeric material phase. The opaque polymeric material phase is, at least in one section of the semi-transparent polymeric material phase, injected in multicomponent injection molding.

From the international patent application WO 2014/060338 A1, a polymeric vehicle pane is known, which has an inner opaque polymeric material phase and an outer semi-transparent, polymeric material phase that are areally bonded to one another. The inner opaque, polymeric material phase has at least one at least partially through-going recess. An LED arrangement that includes at least one LED, one printed circuit board (PCB), and electrical contacting is arranged in the recess. The LED arrangement is positioned such that the LED is positioned in the direction of the outer transparent arrangement.

From the international patent application WO 2013/092253 A1, a heatable luminaire cover is known that has at least one polymeric pane base body as well as a first busbar, a second busbar, and at least two conducting paths that are arranged on the inner surface of the polymeric pane base body. Each conducting path is electrically connected to the first busbar and to the second busbar.

From the international patent application WO 2013/087290 A1, a polymeric workpiece is known that comprises at least an upper main surface and a lower main surface, an injection-mold separating surface, and a flow attack edge surface. The flow attack edge surface is formed in the region between the injection-mold separating surface and the lower main surface as a planar surface with an angle alpha relative to the injection-mold separating surface of 20° to 70° and/or deviates by an amount a of 0.0 mm to 0.5 mm from the planar surface. The polymeric workpiece is used as a pane, as a component of a pane, or as a plastic cover of means of transportation for travel on land, in the air, or on water, in particular as a rear window, windshield, side window, and roof panel as well as a luminaire cover, trim strip, and/or as a vehicle roof of passenger cars, trucks, buses, street cars, subways, trains, and motorcycles.

From the international patent application WO 2008/137946 A1, a polymeric panel system is known that comprises a transparent polymeric panel and an electrically conductive grid. The panel system comprises a substrate, wherein the electrically conductive grid is arranged such that it rests on the substrate. The grid contains at least one electrically conductive mount. Moreover, an electrical connector that comprises a plastic part and an electrically conductive part is attached by ultrasonic welding of the plastic part on the polymeric panel. As a result of the retention of the electrical connector with the panel, the electrically conductive part of the panel makes electrical contact with the electrical connector of the grid. Here, it is disadvantageous that the entire arrangement is comparatively complex and expensive to produce.

From the international patent application WO 2007/076502 A1, an arrangement for defrosting for use in a motor vehicle is known. The arrangement comprises a transparent panel and a defrosting grid that is formed together with the transparent panel using a robotic dispensing machine. The defrosting grid includes first and second busbars as well as a plurality of electrically conductive grid lines that extend between the first and the second busbars.

From the international patent application WO 2006/091955 A1, a method for producing polymeric plastic panes is known. In the method, first, a transparent polymeric panel is produced, which is then covered with a protective layer. Subsequently, electrically conductive ink is applied in the form of a heating grid with a plurality of conducting paths between at least two busbars. After that, the electrically conductive ink is cured and thus the electrical connection to each busbar is produced. Finally, the resistance of the heating grid is reduced by the application of current surges.

From the international patent application WO 2006/063064 A1, a plastic pane with a defroster assembly that comprises a grid of electrically conductive conducting paths that is produced by printing on the transparent plastic with an electrically conductive ink is also known. The electrically conductive ink has a sheet resistivity less than 8 milliohms/square @25.4 μm (Note: the wording was taken from the patent application).

It is common to some of the known plastic panes that the busbars and, sometimes, the conducting paths are produced with electrically conductive inks. Due to the heat sensitivity of the panes made of plastic, these inks cannot be cured at temperatures >300° Celsius, as is possible with glass windows, but only at temperatures <300° Celsius. As a result, the cured busbars and conducting paths on the plastic panes do not automatically achieve the same electrical conductivity as busbars and conducting paths on glass; instead, additional measures must be taken to achieve this, for instance, the use of special inks and/or treatment with high-energy current pulses.

Furthermore, plastic panes with soldered-on or clamped-on metal strips are described in the European patent application EP 2 794 366 A1 or the German patent application DE 000010147537.

From the German patent application DE 10 2009 048 397 A1, an atmospheric pressure plasma method and a corresponding apparatus for producing surface-modified particles and coatings are known. With this method, the plasma is produced by a discharge between electrodes in a process gas. At least one of the electrodes is a sputter electrode, from which particles are sputtered by the discharge. Using this method, composite materials are produced in which surface-modified particles are incorporated into a matrix. Moreover, coatings with particles dispersed therein can be produced, wherein agglomeration problems can be largely avoided even with micro- and nanoparticles.

From the German patent application DE 10 2008 058 783 A1, a method for applying a layer on a nanosurface of a workpiece is known. In this method, an atmospheric plasma jet is produced by electrical discharge in a process gas, and precursor materials spatially separated from the process gas are supplied directly to the plasma jet. The layer applied has a nanosurface corresponding to the nanosurface of the workpiece.

From the German patent application DE 10 2008 029 681 A1, an atmospheric pressure plasma method for application of a self-cleaning layer, in particular a self-cleaning and/or antimicrobially active photocatalytic layer, on a surface is also known. In the method, an atmospheric plasma stream is likewise produced by electrical charge in a process gas, and a precursor material separated from the process gas is introduced directly into the plasma stream as an aerosol.

Consequently the object of the present invention is to find a method for depositing a busbar on vehicle plastic panes with a heating function which no longer has the disadvantages of the prior art. In particular, the method should be simple and fully automated, require no manual labor and only a short cycle time, release no solvent fumes or other harmful substances, and be integratable into the manufacturing process with no problems.

The aforementioned patent applications do not indicate whether and, if so, to what extent the known atmospheric pressure plasma coating (fine powder coating methods, FPC) and the apparatuses used therefor are suitable for production of busbars for vehicle plastic panes with a heating function.

The object of the invention is accomplished according to the invention by a method according to the independent claims. Advantageous embodiments are the subject matter of the dependent claims.

With regard to the prior art, it was surprising and not predictable for the person skilled in the art that the object of the invention could be accomplished using the method according to the invention. Particularly surprising was the fact that the method according to the invention for depositing a busbar on vehicle plastic panes with the heating function no longer had the disadvantages of the prior art. Thus, the method could be carried out simply and fully automated and required no manual labor and only a short cycle time. No solvent vapors or other harmful substances were released, and the method according to the invention could be integrated without problems into the manufacturing process.

The vehicle plastic panes produced using the method according to the invention had outstanding properties from an application technology standpoint and a very long service life.

The vehicle plastic pane produced using the method according to the invention comprises, preferably situated one above another in this order,

- a one- or two-component, semi-transparent, polymeric pane base body,
- a single- or double-layer hardcoat,
- at least one, in particular one, first and at least one, in particular one, second busbar having an opposite electrical charge, which are arranged substantially or exactly parallel to one another at a (certain) distance from one another, in particular near and along two opposite edges of the pane base body, wherein the busbars,
- are electrically connected to one another via at least two, preferably at least three, more preferably at least four, and in particular at least five, conducting paths as heating wires such that upon application of a voltage, a heating current flows from the at least one first busbar to the at least one second busbar, as well as
- on and/or in each busbar at least one, in particular one, connection element for the electrical connection of the at least one first and the at least one second busbar to, in each case, a pole of a voltage source.

The at least one first busbar and the at least one second busbar should have an opposite electrical charge, in other words, are intended to be connected to electrical connectors of opposite polarity.

In a preferred embodiment of the vehicle plastic pane to be produced according to the invention, the arrangement comprising at least one hardcoat, at least two heating wires, and at least one first and at least one second busbar is produced on the inner surface of the pane base body in the installed state. In a particularly preferred embodiment, each heating wire is electrically connected to the first and the second busbar and is supplied with voltage independent of the remaining conducting paths such that damage to one wire does not result in a complete failure of the heating of the vehicle plastic pane.

In context of the present invention. "inner surface" means the side of the vehicle plastic pane that is turned toward an interior space, in particular of a vehicle, and/or of the light source, in particular of the vehicle. In contrast, in the context of the present invention, "outer surface" means the side of the vehicle plastic pane that is turned toward the environment.

In another preferred embodiment of the vehicle plastic pane to be produced according to the invention, the semi-transparent, polymeric pane base body is equipped with an opaque coating in such a way that the busbars are covered at least in the direction of the outer surface of the vehicle plastic pane.

In yet another preferred embodiment, the heating wires are applied partially on the opaque coating and partially on the transparent, polymeric pane base body in such a way that they are embedded in the surfaces in question.

In yet another preferred embodiment, a single- and/or double-layer hardcoat is applied on

- the outer surface of the vehicle plastic panes and/or on their inner surface directly onto the surface of the opaque coating and of the transparent, polymeric pane base body and below the busbars and/or
- its inner surface on the surface of the transparent, polymeric pane base body and the surface of the busbars.

Here, the double-layer hardcoat also has a basecoat that is covered by the hardcoat.

The above-described vehicle plastic panes are produced using the method according to the invention.

In the first process step of the method according to the invention, the transparent, polymeric base body is provided. It has the shape, typically curved, appropriate for the respective application of the vehicle plastic pane. Consequently, it need not be further re-shaped before bonding to the other components of the vehicle plastic pane. However, process steps that are not associated with a change of the curvature of the pane base body, e.g., producing drilled holes, milled holes, or trimming in the edge region, are possible in the context of the method according to the invention.

The transparent, polymeric pane base body is provided according to the invention before the heating wires are applied. The heating wires are, consequently, not stressed during re-shaping of the pane base body. The particular advantage resides in the avoidance of damage to the heating wires and/or their electrical contacting. In addition, stable electrical contacting of each individual heating wire is provided by the first and the second busbar.

The transparent, polymeric pane base body can be produced by all suitable methods of plastic processing known to the person skilled in the art, for example, by thermoforming. In a preferred embodiment of the method according to the invention, the transparent, polymeric pane base body is produced by injection molding, or by the two-component injection compression molding method with rotary table technology. This method enables production of a relatively large number of suitable shapes. In addition, the transparent, polymeric pane base body can be produced virtually waste free, since subsequent trimming of the workpiece is unnecessary. Likewise, complex surface structures can be produced directly.

The transparent, polymeric pane base body preferably contains at least polyethylene (PE), polycarbonates (PC), polypropylene (PP), polystyrene, polybutadiene, polynitriles, polyesters, in particular polyethylene terephthalate (PET), polyurethanes (PU), polymethylmethacrylates (PMMA), polyacrylates, polyamides (PA), acrylonitrile butadiene styrene copolymers (ABS), styrene acrylonitrile copolymers (SAN), acrylonitrile styrene acrylester copolymers (ASA), acrylonitrile butadiene styrene-polycarbonate blends (ABS/PC), and/or their copolymers, co-condensates and/or their blends.

Particularly preferably, the transparent, polymeric pane base body contains polycarbonate (PC) and/or polymethylmethacrylate (PMMA) or is made of these polymers. These are proving to be particularly advantageous in terms of transparency, processing, strength, weather resistance, and chemical resistance.

The semi-transparent, polymeric pane base body preferably has a thickness of 2 mm to 6 mm. This is particularly advantageous in terms of the strength and the processing of the polymeric pane base body. The size of the semi-transparent, polymeric pane base body can vary widely and is governed by the use according to the invention.

The semi-transparent, polymeric pane base body is, according to the invention, transparent, at least in regions. The polymeric pane base body can be colorless, colored, or tinted. The polymeric pane base body can be clear or cloudy, but, in particular, clear.

The heating wires preferably run rectilinearly between the first and the second busbar. The heating wires can, however, also run, for example, wavelike, meanderingly, or in the form of a zigzag pattern between the first and the second busbar. The distance between two adjacent heating wires is preferably constant over the entire length of the heating wires. The distance between two adjacent heating wires can, however, also change in the run between the first and the second busbar.

The heating wires can run in any desired direction, but, preferably, horizontally or vertically. The heating wires are preferably applied by means of ultrasonic embedding on the semi-transparent, polymeric pane base body and, to the extent present, on the opaque coating. A sonotrode is preferably guided over the inner surface of the semi-transparent, polymeric pane base body by a multi-axis robot by means of a robot program adapted to the three-dimensional geometry of the semi-transparent polymeric pane base body. The sonotrode transmits high-frequency mechanical oscillations (ultrasound) generated by an ultrasonic generator to the semi-transparent, polymeric pane base and, to the extent present, to the opaque coating. Heat is generated and a surface layer of the inner side of the semi-transparent, polymeric pane base body is melted. The heating wires are introduced into the melted surface layer. For this, the sonotrode guides a heating wire on its tip, with the heating wire continuously supplied from a spool of wire near the sonotrode. A tool suitable as a sonotrode is known, for example, from U.S. Pat. No. 6,023,837 A.

The penetration depth of the heating wires into the semi-transparent polymeric pane base body as well as, optionally, into the opaque coating is preferably from 50% to 90%, particularly preferably from 60% to 75% of the thickness of the heating wires. The uncomplicated application of the heating wires using ultrasonic embedding is particularly advantageous in terms of a stable bond between the heating wires and the semi-transparent, polymeric pane base body as well as, optionally, the opaque coating.

The distance between two adjacent heating wires is preferably from 1 mm to 25 mm, particularly preferably 3 mm to 15 mm. This is particularly advantageous in terms of the transparency of the vehicle plastic pane and the distribution of the heating power introduced via the heating wires. The length of the heating wires can vary widely and thus be readily adapted to the requirements in the individual case. The heating wires have, for example, lengths from 5 cm to 50 cm.

The heating wires contain at least one metal, preferably tungsten, copper, nickel, manganese, aluminum, silver, chromium, and/or iron, as well as mixtures and/or alloys thereof. The heating wires particularly preferably contain tungsten and/or copper. A particularly good heating effect is thus achieved. The thickness of the heating wires is preferably from 15 μm to 200 μm, particularly preferably from 25 μm to 90 μm. This is particularly advantageous in terms of the transparency of the vehicle plastic pane, the heating power introduced, and the avoidance of short circuits.

It has been demonstrated that particularly good results are obtained with heating wires that contain tungsten and have a thickness of preferably 15 μm to 100 μm, particularly preferably of 25 μm to 50 μm. Particularly good results are also achieved with heating wires that contain copper and have a thickness of preferably 25 μm to 200 μm, particularly preferably 60 μm to 90 μm.

Adjacent heating wires can be connected to one another on the side of the first busbar facing away from the second busbar or on the side of the second busbar facing away from the first busbar. The heating wires can thus be applied in the form of a single heating wire on the semi-transparent, polymeric pane base body as well as, optionally, on the opaque coating, with the heating wire, after application, comprising two or more sections that are provided as conducting paths and that are connected to one another loop-wise. Each section of the heating wire provided as a conducting path is connected in the region of one end to the first busbar and in the region of the other end to the second busbar. Each section of the heating wire in the region of the busbars and between the busbars forms a conducting path.

Alternatively, it is possible for adjacent heating wires to not be connected to one another on the side of the first busbar facing away from the second busbar and on the side of the second busbar facing away from the first busbar. The conducting paths are thus applied in the form of a plurality of heating wires on the semi-transparent, polymeric pane base body as well as, optionally, on the opaque coating, with each heating wire connected in the region of one end to the first busbar and in the region of the other end to the second busbar. Each heating wire comprises a conducting path in the region of the busbars and between the busbars.

At least one section of each heating wire is embedded in the semi-transparent, polymeric pane base body as well as, optionally, in the opaque coating. The heating wires can be embedded in the semi-transparent polymeric pane base body along their entire length. This is particularly advantageous in terms of a stable connection between the semi-transparent, polymeric pane base body and the heating wires. The electrical contacting with the first and the second busbar is then done on the side of the heating wires facing away from the semi-transparent, polymeric pane base body as well as, optionally, from the opaque coating.

In an advantageous embodiment of the invention, the regions on the ends of the heating wires provided for electrical contacting with the busbars are not embedded in the semi-transparent, polymeric pane base body as well as, optionally, in the opaque coating and can be lifted off it. The particular advantage resides in the possibility of simple and stable electrical contacting with the busbars. The particular advantage resides in effective and very stable contacting of the heating wires. For the heating of the vehicle plastic pane, an electrical potential is applied to the first lower or left busbar in the installed state and the second upper or right busbar in the installed state.

According to the invention, the first and the second busbars are applied using the FPC method. For this, a metal powder is introduced into an atmospheric pressure plasma, melted in the plasma jet, and guided to the substrate to be coated, comprising the heating wires as well as the pane base body and/or, optionally, the opaque coating and/or, optionally, the hardcoat, onto which a metal layer is, consequently, deposited.

Preferably, the metal powder is selected from the group consisting of powders of titanium, zirconium, hafnium, vanadium, niobium, tantalum, chromium, molybdenum, tungsten, manganese, rhenium, iron, ruthenium, osmium, cobalt, rhodium, iridium, nickel, palladium, platinum, copper, silver, gold, zinc, and aluminum and their mixtures and alloys of at least two of these metals. Preferably used are tungsten, copper, nickel, manganese, aluminum, silver, chromium, and/or iron as well as their mixtures and/or alloys. Particularly preferably used is copper or aluminum.

The fine powder coating (FPC) process or atmospheric pressure plasma coating is a customary, known method, for which customary, known apparatuses are used. Examples of suitable methods and apparatuses are indicated in the German patent applications

Figure 2:
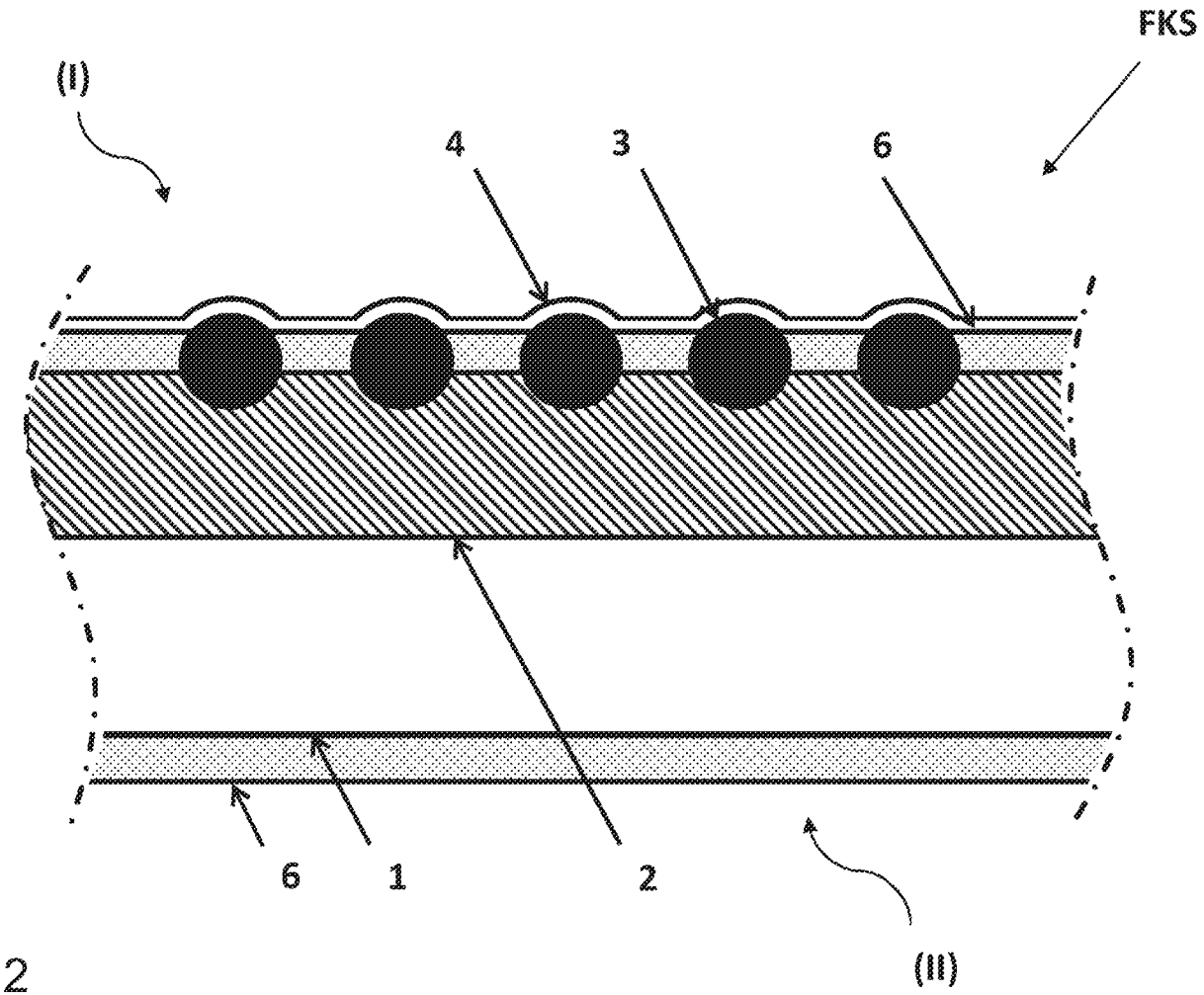
Figure 3:
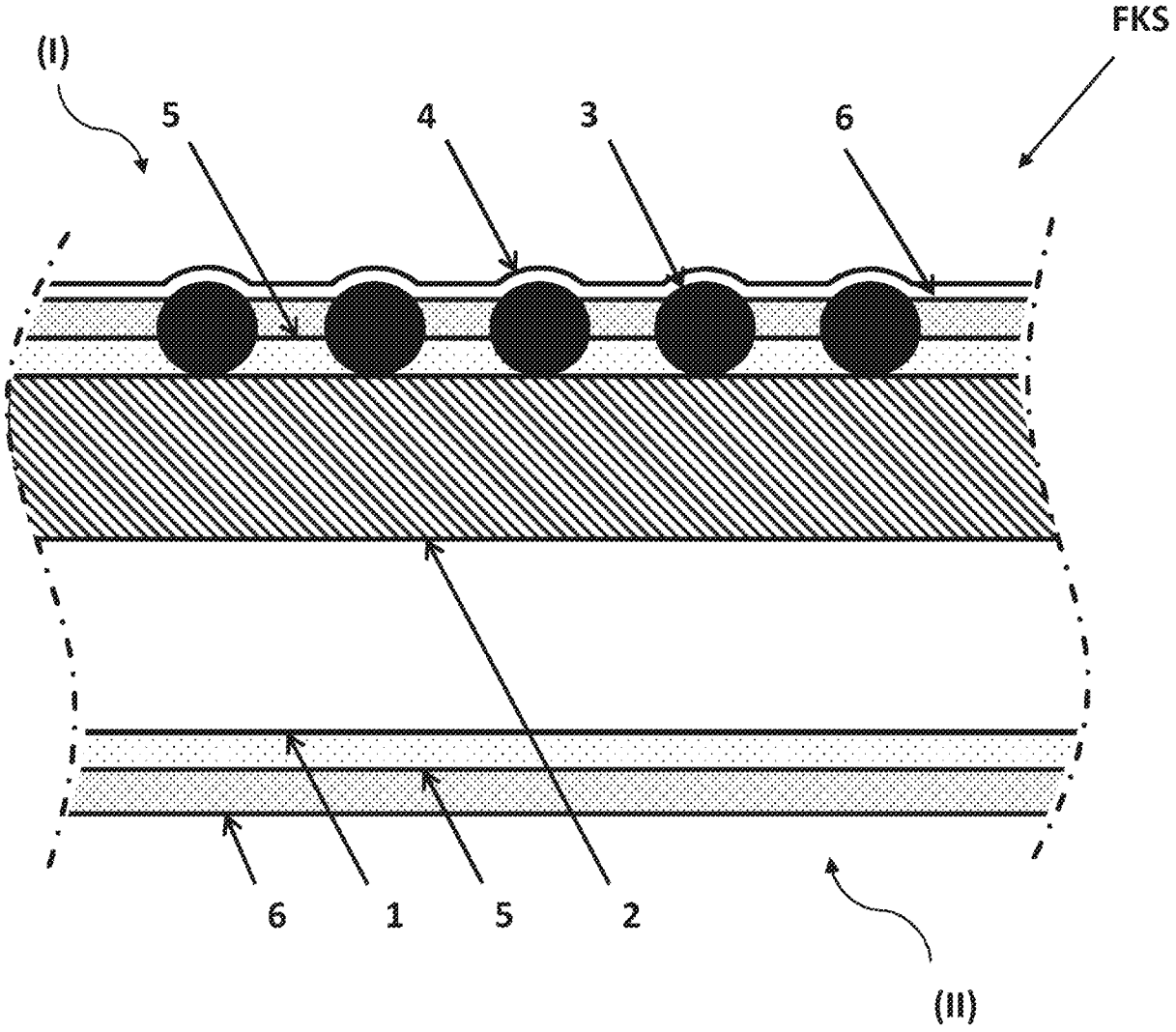

- DE 10 2009 048297 A1, paragraphs [0017] to [0070] in conjunction with FIG. 1 to 3,
- DE 10 2008 058783 A 1, paragraphs [0001] to [0044] in conjunction with FIG. 1 to 2*c*, and
- DE 10 2008 029 681 A1, paragraphs [0010] to [0045] in conjunction with FIG. 1 to 4.

The busbars preferably have a thickness of 10 μm to 200 μm, particularly preferably of 50 μm to 100 μm. The width of a busbar, along which the busbar is connected to heating wires, is preferably from 2 mm to 100 mm, particularly preferably from 5 mm to 20 mm. The length of the busbars can vary widely and thus be ideally adapted to the requirements of the individual case. The minimum length of the busbars results from the number of heating wires in the distance between adjacent heating wires. The length of the busbars is, for example, from 5 cm to 20 cm. The busbars are connected to an external power supply such that an electric potential difference can be applied between the first and second busbar.

For aesthetic reasons, it can be desirable for the electrical contacting of the heating wires using the busbars to not be visible from the outside. To that end, for example, the semi-transparent, polymeric pane base body can be colored or blackened in the region of the busbars. The semi-transparent, polymeric pane base body can, for example, be produced by multicomponent injection molding, with the semi-transparent polymeric pane base body including, in the regions on which the busbars are to be arranged, an opaque coating that obscures the view of the electrical contacting through the semi-transparent, polymeric pane base body.

The opaque coating of the semi-transparent, polymeric pane base body preferably contains at least polyethylene (PE), polycarbonates (PC), polypropylene (PP), polystyrene, polybutadiene, polynitriles, polyesters, polyurethanes, polymethylmethacrylates, polyacrylates, polyesters, polyamides, polyethylene terephthalate, acrylonitrile butadiene styrene (ABS), styrene acrylonitrile (SAN), acrylonitrile styrene acrylester (ASA), acrylonitrile butadiene styrene-polycarbonate (ABS/PC) and/or copolymers and co-condensates or mixtures thereof, particularly preferably polycarbonates (PC), polyethylene terephthalate (PET), and/or polymethylmethacrylate (PMMA).

The opaque coating of the semi-transparent, polymeric pane base body preferably contains at least one colorant. The opacity of the coating is achieved by means of the colorant. The colorant can contain inorganic and/or organic dyes and/or pigments. The colorant can be colored or uncolored. Suitable colorants are known to the person skilled in the art and can, for example, be looked up in the *Colour Index der British Society of Dyers and Colourists* and the *American Association of Textile Chemists and Colorists*. Preferably, a black pigment is used as the colorant, for example, carbon black, aniline black, bone black, iron oxide black, spinel black, and/or graphite. Thus, a black opaque coating is obtained The opaque coating can further contain inorganic or organic fillers, particularly preferably $SiO_2$, $Al_2O_3$, $TiO_2$, clay minerals, silicates, zeolites, glass fibers, carbon fibers, glass beads, organic fibers, and/or mixtures thereof. The fillers can further increase the stability of the opaque coating. Moreover, the fillers can reduce the amount of polymeric materials and thus reduce the production costs of the vehicle plastic pane.

Alternatively, a colored or blackened element can be arranged between the busbars and the semitransparent, polymeric pane base body. Alternatively, masking screen prints can be applied on a surface of the semi-transparent, polymeric pane base body.

In the method according to the invention, a single- or double-layer hardcoat is further applied on the outer surface of the semi-transparent, polymeric pane base body to protect the vehicle plastic pane to be made according to the invention against environmental influences. Preferably used are thermally curing or UV curing coating systems based on polysiloxanes, polyacrylates, polymethacrylates, and/or polyurethanes. The hardcoat preferably has a layer thickness of 1 μm to 50 μm, particularly preferably of 2 μm to 25 μm. The particular advantage resides in the increased scratch resistance and weather resistance of the semi-transparent, polymeric pane base body due to the protective coating.

In the context of the present invention, "double-layer hardcoat" means a combination of at least one, in particular one, hardcoat with at least one, in particular one, base coat covered by the hardcoat and described in detail below.

Additionally, the single- or double-layer hardcoat can also be applied on the inner surface of the vehicle plastic pane to be produced according to the invention. It can be applied directly on the surface of the semi-transparent, polymeric pane base body and of the opaque coating such that the heating wires are also embedded in the hardcoat and the busbars cover the hardcoat.

The additional single- or double-layer hardcoat can, however, also be applied in such a way that it covers the busbars.

In addition to coloring compounds and pigments, the hardcoat can also contain UV-blockers and preservatives as well as components for increasing scratch resistance, for example, nanoparticles.

The hardcoat can, for example, be applied on the outer surface and/or the inner surface of the semi-transparent, polymeric pane base body by a dipping, flooding, or spraying method. After application, the hardcoat is cured preferably by temperature and/or UV light input. In the case of production of the polymeric pane base body by injection molding, the hardcoat can also be applied on the outer surface of the polymeric pane base body by an in-mold coating method.

Products suitable as a protective coating are, for example, AS4000, AS4700, PHC587, or UVHC3000, which are provided by the company Momentive Performance Materials.

The hardcoat can also comprise a plurality of layers, preferably a basecoat that also functions as an adhesion-promoting layer or primer on the semi-transparent, polymeric pane base body. The basecoat can, for example, contain acrylates and have a layer thickness of 0.4 μm to 5 μm. The hardcoat can contain, for example, polysiloxanes and typically has a layer thickness of 3 μm to 15 μm. Moreover, the hardcoat can additionally be covered with a plasma CVD layer, such as Exateco 900.

The protective coating, i.e., the hardcoat as well as, optionally, the basecoat, can be applied before or after the application of the heating wires and busbars. The protective coating can be applied before or after the connection of the heating wires to the busbars.

In a preferred embodiment, the surfaces on which the busbars are applied by the FPC method can also be activated before the application in order to ensure better adhesion of the metal layer. For this, silane-based adhesion promoters or chemical activators can be used, or the surfaces can be activated using plasma activation. This plasma activation can be immediately upstream from the deposition process and can be realized by an additional plasma nozzle on the robot arm of the apparatus for atmospheric pressure plasma coating.

The heatable vehicle plastic panes are preferably used as panes for means of transportation on land, in the air, and/or on water, in particular for passenger cars, trucks, buses, streetcars, subways, trains, motorcycles, watercraft, and aircraft as well as decorative elements and/or as architectonic elements.

Moreover, the heatable vehicle plastic panes can advantageously be used as a cover for luminaries of means of transportation for travel on land, in the air, or on water, in particular for headlights, taillights, side marker lights, and/or position lights of passenger cars, trucks, buses, streetcars, subways, trains, motorcycles, watercraft, and aircraft.

Figure 4:
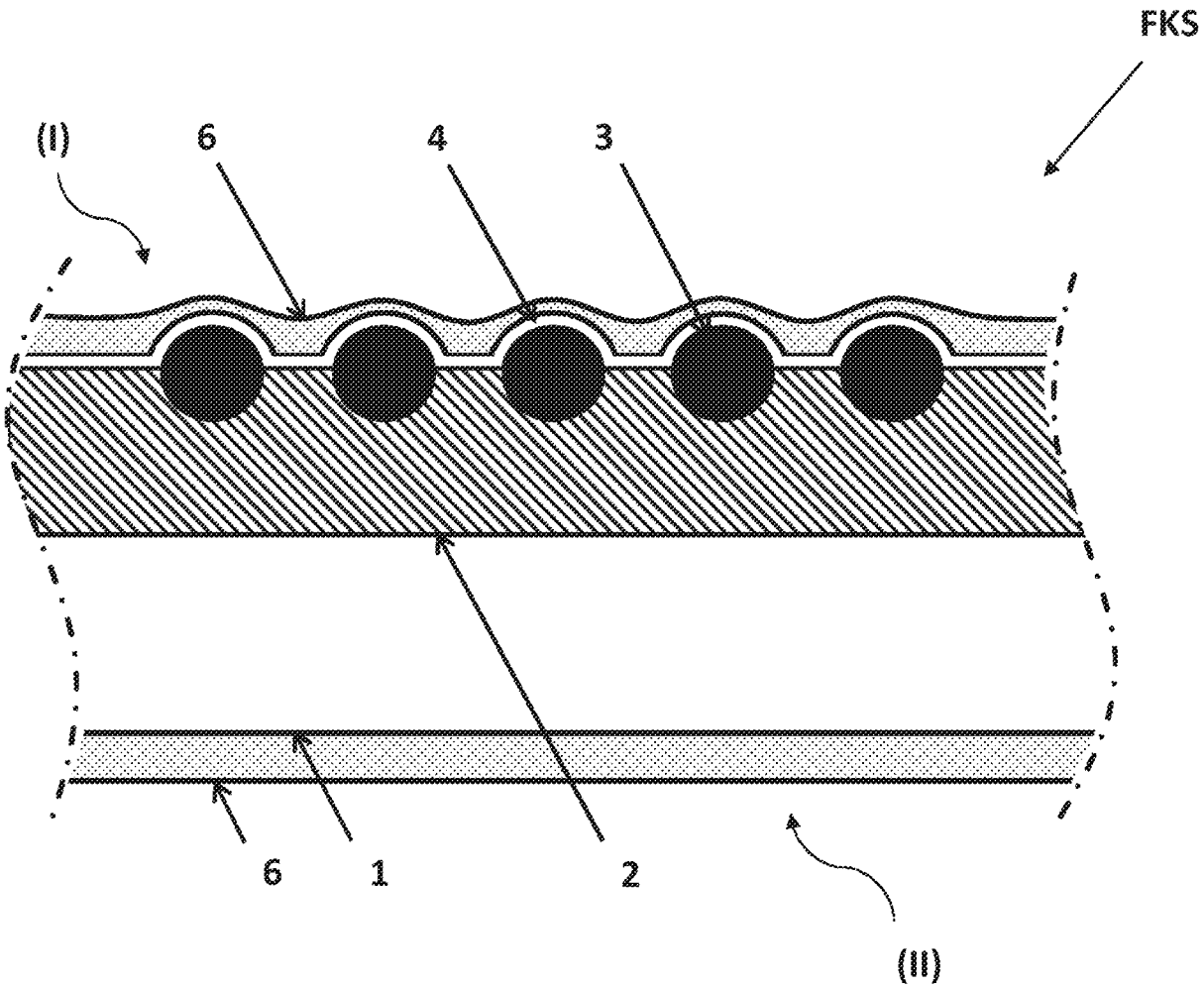
Figure 5:
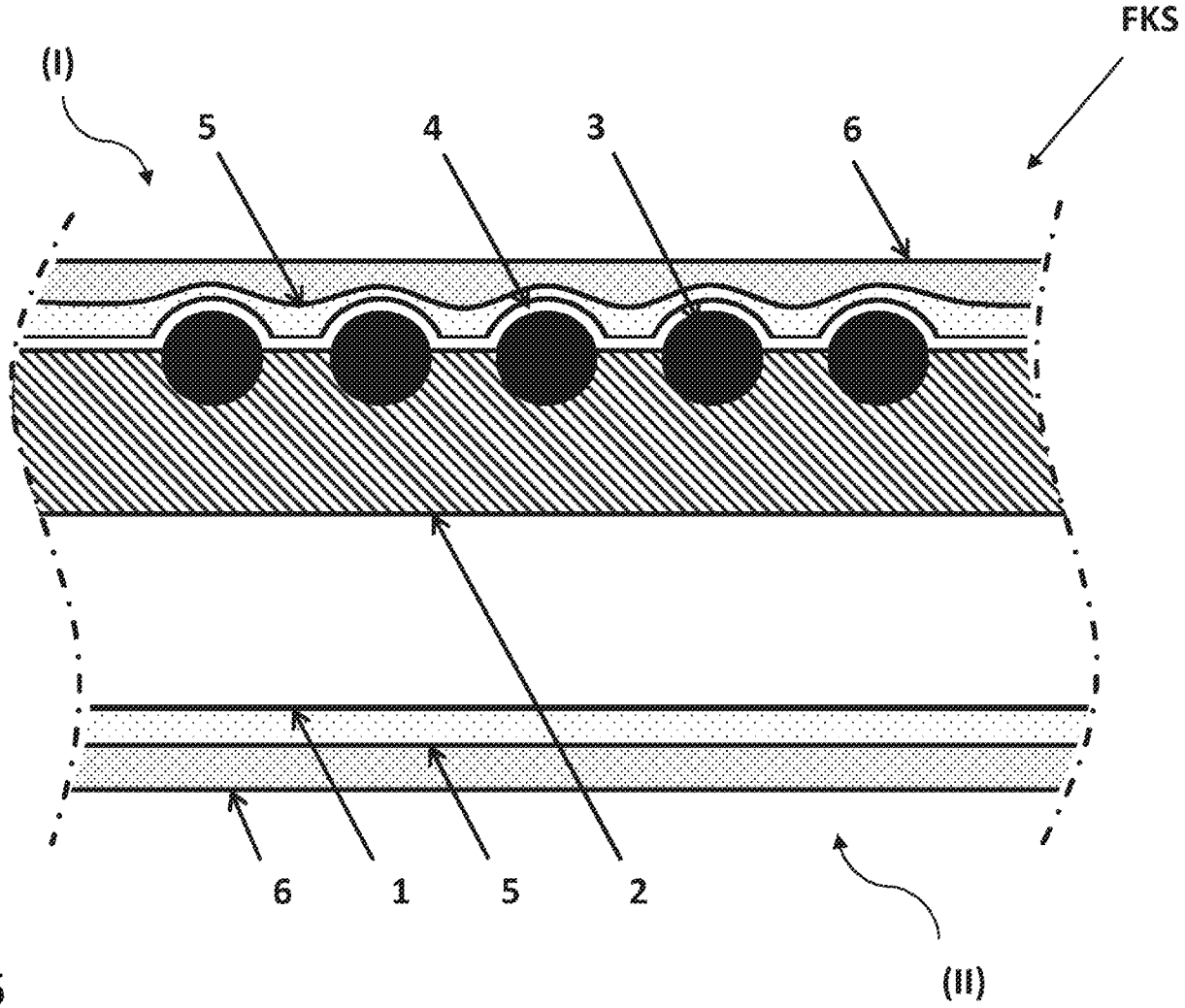

The invention is explained in detail with reference to drawings and exemplary embodiments. The drawings are schematic representations and not true to scale. The drawings in no way restrict the invention. They depict:

FIG. 1 a cross-section through a detail of a first embodiment of a vehicle plastic pane FKS produced according to the invention, FIG. 2 a cross-section through a detail of a second embodiment of a vehicle plastic pane FKS produced according to the invention, FIG. 3 a cross-section through a detail of a third embodiment of a vehicle plastic pane FKS produced according to the invention, FIG. 4 a cross-section through a detail of a fourth embodiment of a vehicle plastic pane FKS produced according to the invention, FIG. 5 a cross-section through a detail of a fifth embodiment of a vehicle plastic pane FKS produced according to the invention.

Figure 6:
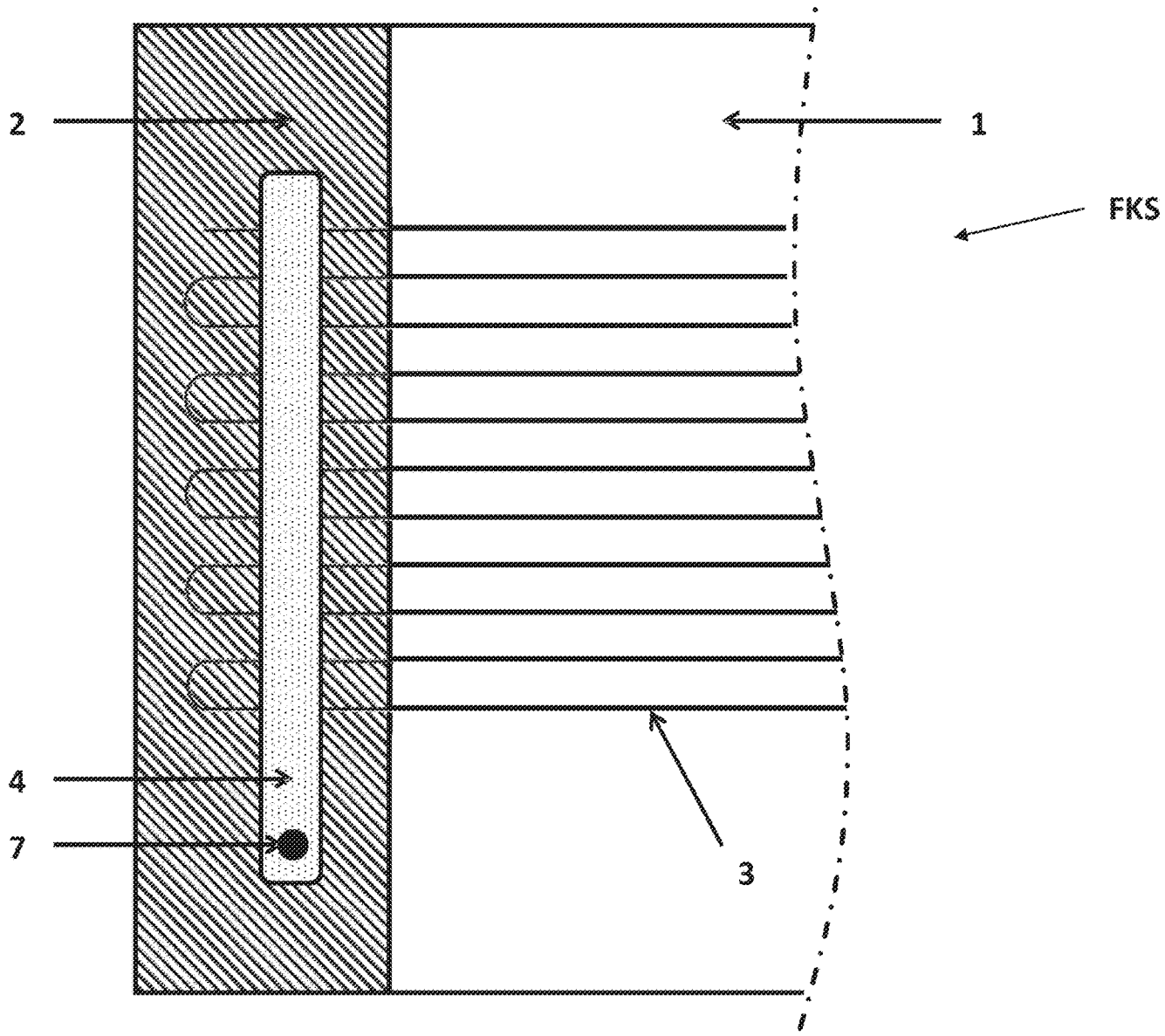
Figure 7:
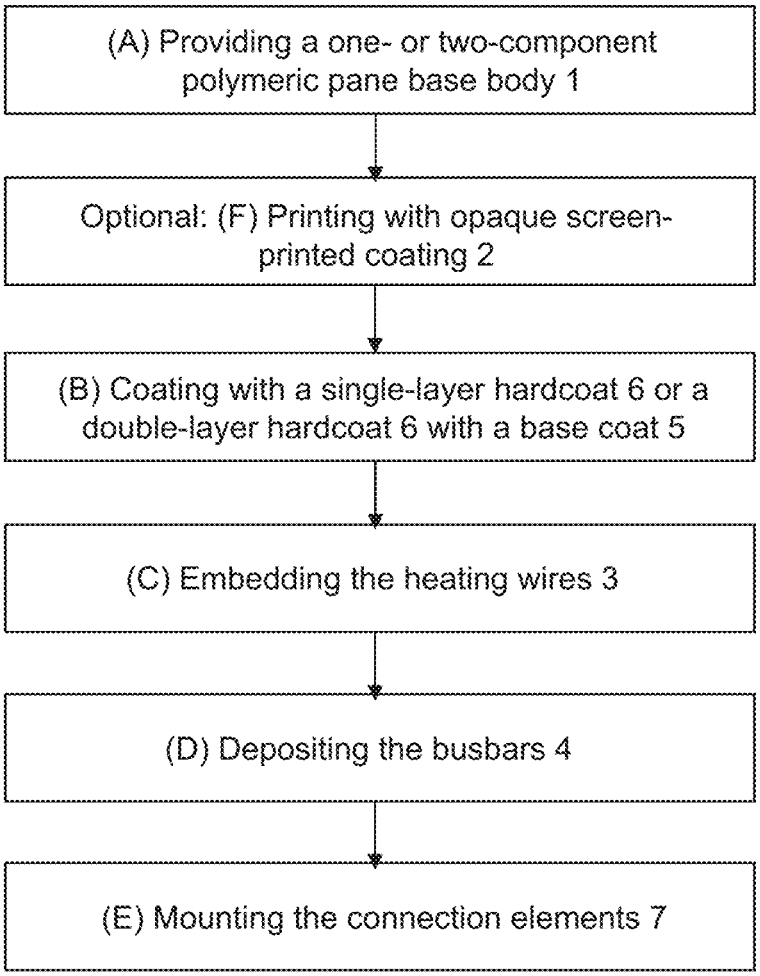
Figure 8:
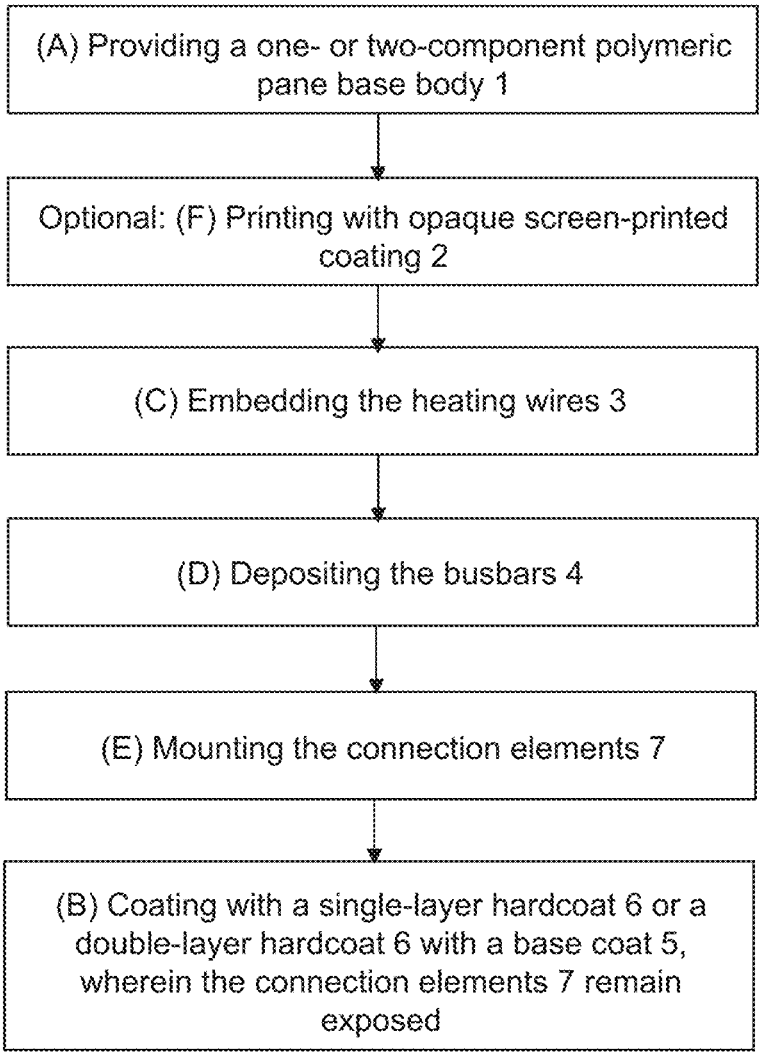

FIG. 6 a plan view of a detail of a first embodiment of a vehicle plastic pane FKS produced according to the invention, FIG. 7 a flowchart of an embodiment of the method according to the invention, and FIG. 8 a flowchart of another embodiment of the method according to the invention.

DETAILED DESCRIPTION OF THE FIGURES

FIG. 7 depicts the flowchart of a preferred embodiment of the method according to the invention. The process step A comprised providing two semi-transparent, polymeric pane base bodies 1 made of polycarbonate PC for producing vehicle plastic panes FKS, as they are used for rear windows of passenger cars. The pane base bodies 1 have the dimensions 1 m×0.5 m×0.004 m.

In the following process step F, each pane base body 1 was provided, in the edge region using screen printing, with a 0.05-m-wide, 10-μm-thick, peripheral opaque, carbon-black-pigment-containing coating 2 based on polyurethane PU.

Then, the outer surface II of one pane base body 1 was coated, in the process step B, by flow coating with a commercially available single-layer hardcoat 6 (PHC587C of the company Momentive Performance Materials).

In a variant of the process step B, first, a customary, known basecoat 5 (SHP470 of the company Momentive Performance Materials) with a thickness of, on average, 3 μm was applied on the outer surface II of the other pane base body 1 by flow coating. After the curing of the basecoat 5, the hardcoat 6 (AS4700 of the company Momentive Performance Materials) was applied and also dried.

After that, in the process step C, a tungsten wire of a length of 1710 mm and a thickness of 60 μm was applied on the inner surface I in the form of 38 loops, whose distance from one another in the region of the rectilinear wire sections running parallel to one another was roughly 25 mm (cf. the configuration of FIG. 6), using ultrasonic embedding. The penetration depth of the heating wire was 65% of its thickness.

Then, in the process step D, at a distance of 50 mm from the two long edges parallel to one another, in each case, a busbar 4 of a length of 980 mm, along which the busbars 4 were connected to heating wires 3, was applied using the FPC method in a width of 15 mm and a thickness of 75 μm. It was found that the electrical contact between the busbars 4 and the heating wire 3 was excellent and virtually loss free.

Finally, in the process step E, a connection element 7 for contacting one pole of a current source in each case was applied in each case on the busbars.

FIG. 8 depicts the flowchart of another preferred embodiment of the method according to the invention, which differs from the first embodiment in that the coating B with a single-layer hardcoat 6 or a double-layer hardcoat 6 with a base coat 5 were applied both on the inner surface I and the outer surface II by flow coating after the process steps A, F, C, D, E, wherein care had to be taken that the connection elements 7 remained exposed such that they could be electrically connected to the poles of a voltage source.

Further preferred embodiments could easily be indicated because they resulted from the desired structure of the vehicle plastic panes to be produced according to the invention.

FIG. 1 to 5 depict cross-sections of details of the vehicle plastic panes FKS producible according to the invention. The respective embodiment of the method according to the invention resulted simply from the respective desired structure of the vehicle plastic panes FKS. The details of FIG. 1 to 5 depicted the configuration of FIG. 6 in plain view.

Thus, FIG. 1 depicts, viewed from the inner surface I to the outer surface II, a busbar 4, which covered the contact points with the loop-shaped heating wire 3. The heating wire 3 was embedded in the opaque coating 2. The opaque coating 2 was situated on the semi-transparent, polymeric pane base body 1. The outer surface II was covered with a hardcoat 6.

FIG. 2 depicts, viewed from the inner surface I to the outer surface II, a busbar 4, which covered the contact points with the loop-shaped heating wire 3. The heating wire itself 3 was embedded in the hardcoat 6 and the opaque coating 2 positioned thereunder. The opaque coating 2 was in turn situated on the semi-transparent, polymeric pane base body 1. The outer surface II was likewise covered with a hardcoat 6.

FIG. 3 depicts, viewed from the inner surface I to the outer surface II, a busbar 4, which covered the contact points with the loop-shaped heating wire 3. The heating wire 3 itself was embedded in the hardcoat 6 and in a basecoat 5 positioned thereunder, which was situated on the opaque coating 2. The opaque coating 2 was in turn situated on the semi-transparent, polymeric pane base body 1. The outer surface II was likewise covered with a basecoat 5 and a hardcoat 6.

FIG. 4 depicts, viewed from the inner surface I to the outer surface II, a hardcoat 6 on a busbar 4, which covered the contact points with the loop-shaped heating wire 3. The heating wire 3 itself was embedded in the opaque coating 2. The opaque coating 2 was in turn situated on the semi-transparent, polymeric pane base body 1. The outer surface II was likewise covered with a hardcoat 6.

FIG. 5 depicts, viewed from the inner surface I to the outer surface II, a hardcoat 6 on a basecoat 5, which covered the busbar 4. The busbar 4 in turn covered the contact points with the loop-shaped heating wire 3. The heating wire 3 itself was embedded in the opaque coating 2. The opaque coating 2 was in turn situated on the semi-transparent, polymeric pane base body 1. The outer surface II was likewise covered with a basecoat 5 and a hardcoat 6.

In the figures, the reference characters have the following meaning:

1 semi-transparent, polymeric pane base body
2 opaque coating
3 heating wires
4 busbar
5 basecoat
6 hardcoat
7 connection element
I inner surface
II outer surface
FKS vehicle plastic pane

The invention claimed is:

1. A method for producing a vehicle plastic pane having a heating function, the vehicle plastic pane comprising:

i) a one- or two-component, semi-transparent, polymeric pane base body, ii) a coating comprising a single-layer hardcoat or double-layer hardcoat with a basecoat, and iii) a first and a second busbar configured to carry opposing electrical charge, which are arranged substantially parallel to one another at a certain distance from one another, wherein the busbars have a thickness of 10 μm to 200 μm, wherein the first and second busbars are electrically connected to one another using at least two conducting paths as heating wires, such that upon application of a voltage, a heating current flows from the first busbar to the second busbar, wherein on and/or in each of the first and the second busbar, there is provided at least one connection element for the electrical connection of each of the first and the second busbar to a respective pole of a voltage source, and wherein producing of the vehicle plastic pane comprises performing the following process steps (A) through (E) in order:

(A) providing the one- or two-component, semi-transparent, polymeric pane base body, (B) coating the pane base body with the coating, (C) embedding the heating wires for direct electrical contact with the busbars, (D) depositing the first and the second busbars for direct electrical contact with the heating wires, and (E) mounting at least one connection element on and/or in each of the first and the second busbar, wherein the process step (D) is performed using a fine powder coating (FPC) plasma process at atmospheric pressure.

2. A method for producing a vehicle plastic pane having a heating function, the vehicle plastic pane comprising:

i) a one- or two-component, semi-transparent, polymeric pane base body, ii) a coating comprising a single-layer hardcoat or double-layer hardcoat with a basecoat, and iii) a first and a second busbar configured to carry opposing electrical charge, which are arranged substantially parallel to one another at a certain distance from one another, wherein the busbars have a thickness of 10 μm to 200 μm, wherein the first and second busbars are electrically connected to one another using at least two conducting paths as heating wires, such that upon application of a voltage, a heating current flows from the first busbar to the second busbar, wherein on and/or in each of the first and the second busbar, there is provided at least one connection element for the electrical connection of each of the first and the second busbar to a respective pole of a voltage source, and wherein producing of the vehicle plastic pane comprises performing the following process steps:

(A) providing the one- or two-component, semi-transparent, polymeric pane base body, (B) coating the pane base body with the coating, (C) embedding the heating wires for direct electrical contact with the busbars, (D) depositing the first and the second busbars for direct electrical contact with the heating wires, and (E) mounting at least one connection element on and/or in each of the first and the second busbar, wherein the producing of the vehicle plastic pane comprises performing the process steps (A), (C), (D), (E) and (B) in that order, wherein the at least one connection element remains exposed, and wherein the process step (D) is performed using a fine powder coating (FPC) plasma process at atmospheric pressure.

3. The method according to claim 1, wherein the producing of the vehicle plastic pane further comprises performing a process step (F), comprising:

(F) covering the semi-transparent, polymeric pane base body, at least in a region of the first and second busbars, with an opaque coating so that said busbars are optically covered at least in a direction of an outer surface of the vehicle plastic pane.

4. The method according to claim 3, wherein the process step (F) is performed after the process step (A) and before the process step (B).

5. The method according to claim 3, wherein the process step (F) is performed before the process step (C).

6. The method according to claim 1, wherein the embedding of the heating wires during the process step (C) is performed so that at least one section of each of the heating wires is embedded in the semi-transparent, polymeric pane base body.

7. The method according to claim 1, wherein the heating wires are partially exposed, at least in a region of the first and second busbars, so that the heating wires are in direct electrical contact with said busbars.

8. The method according to claim 1, wherein the embedding of the heating wires during the process step (C) is done using ultrasonic embedding.

9. The method according to claim 1, wherein the process step (B) is performed using flow coating.

10. The method according to claim 1, wherein the producing of the vehicle plastic pane further comprises performing a process step (G) before the process step (D), the process step (G) comprising:

(G) activating a polymeric surface and/or a coating surface on which the first and the second busbar are to be applied.

11. The method according to claim 10, wherein the activating during the process step (G) is done with one or more of: a) chemical activators, and b) silane-based adhesion promoters.

12. The method according to claim 11, wherein the activating during the process step (G) is done by means of a plasma activation.

13. The method according to claim 1, wherein the depositing during the process step (D) further comprises:

introducing a metal powder into an atmospheric pressure plasma, melting the metal powder in a plasma jet, and guiding the melted metal power onto a substrate to be coated, wherein the substrate to be coated comprises the heating wires, the polymeric pane base body, and the hardcoat, onto which a metal layer is deposited as a result.

14. The method according to claim 13, wherein the metal powder is selected from a group consisting of powders of titanium, zirconium, hafnium, vanadium, niobium, tantalum, chromium, molybdenum, tungsten, manganese, rhenium, iron, ruthenium, osmium, cobalt, rhodium, iridium, nickel, palladium, platinum, copper, silver, gold, zinc, and aluminum, and mixtures or alloys of at least two of said metals.

15. A method, comprising use of a fine powder coating (FPC) plasma process at atmospheric pressure for production of a vehicle plastic pane having a heating function.

16. The method according to claim 15, wherein the vehicle plastic pane is used as a pane for means of transportation comprising one or more of: a) transportation on land, b) transportation in the air, and c) transportation on water.

17. The method according to claim 15, wherein the vehicle plastic pane is used as a decorative or architectonic element.

* * * * *